US009782734B2

(12) United States Patent
Heide-Jørgensen et al.

(10) Patent No.: US 9,782,734 B2
(45) Date of Patent: Oct. 10, 2017

(54) INTEGRATED ROTARY MIXER AND DISPERSER HEAD

(71) Applicant: ADMIX, INC., Londonderry, NH (US)

(72) Inventors: Jens Peter Heide-Jørgensen, Vedbæk (DK); Peter Leitner, Chester, NH (US)

(73) Assignee: ADMIX, INC., Londonderry, NH (US)

( * ) Notice: Subject to any disclaimer, the term of this patent is extended or adjusted under 35 U.S.C. 154(b) by 100 days.

(21) Appl. No.: 14/984,382

(22) Filed: Dec. 30, 2015

(65) Prior Publication Data

US 2016/0107130 A1 Apr. 21, 2016

Related U.S. Application Data

(63) Continuation of application No. PCT/IB2013/055454, filed on Jul. 3, 2013.

(51) Int. Cl.
*B01F 5/06* (2006.01)
*B01F 7/00* (2006.01)

(52) U.S. Cl.
CPC ..... *B01F 5/0662* (2013.01); *B01F 7/00316* (2013.01); *B01F 7/00358* (2013.01); *B01F 7/00508* (2013.01); *B01F 7/00633* (2013.01)

(58) Field of Classification Search
CPC ..... B01F 5/0662; B01F 7/00316; B01F 7/00358; B01F 7/00508; B01F 7/00633
USPC ..... 366/293, 262
See application file for complete search history.

(56) References Cited

U.S. PATENT DOCUMENTS 1,908,002 A * 5/1933 Valentine ..... B01F 7/00241 159/4.2
2,193,686 A * 3/1940 Craddock ..... B01F 7/00341 416/228
2,461,720 A * 2/1949 Cawood ..... B01F 7/1645 241/46.11
3,170,638 A * 2/1965 Burton ..... B01F 7/005 241/46.17

(Continued)

FOREIGN PATENT DOCUMENTS

DE 655503 C 1/1938
JP S55-147141 A 11/1980

(Continued)

OTHER PUBLICATIONS

International search report from PCT/IB2013/055454 dated Mar. 21, 2014.

*Primary Examiner* — Tony G Soohoo
(74) *Attorney, Agent, or Firm* — McLane Middleton, Professional Association

(57) ABSTRACT

The invention pertains to a rotary mixer and disperser head consisting of a shaft to which is connected a mixing chamber that is to be disposed into a vat or the like for dispersing, dissolving or blending of solids liquids or gasses with other liquids. The mixing chamber has secured to its upper and lower ends a plurality of impeller blades which have an end thereof located outside the mixing chamber to direct material into the mixing chamber and out through openings in the side wall of the mixing chamber during the mixing and dispersing thereof. The mixer and disperser head also comprises shear arms having a sharpened leading edge, thereby providing an additional initial shear zone. The specific mixing chamber and its configuration provide for a very efficient mixing operation.

22 Claims, 5 Drawing Sheets

(56) References Cited

U.S. PATENT DOCUMENTS

| | | | | | |
|---|---|---|---|---|---|
| 3,290,016 | A | | 12/1966 | Lennon et al. | |
| 3,785,777 | A | * | 1/1974 | Porter | B01F 7/164 366/251 |
| 4,490,049 | A | * | 12/1984 | Sanders | B01F 7/00908 366/134 |
| 4,515,482 | A | * | 5/1985 | Schadewald | B01F 5/12 366/136 |
| 4,900,159 | A | * | 2/1990 | Jamison | B01F 7/005 366/262 |
| 5,407,271 | A | * | 4/1995 | Jorgensen | B01F 7/005 241/46.17 |
| 6,257,753 | B1 | * | 7/2001 | King | B01F 7/00241 366/129 |
| 6,971,788 | B1 | * | 12/2005 | Gringer | B01F 7/00241 366/265 |
| 2016/0107130 | A1 | * | 4/2016 | Heide-Jorgensen | B01F 7/00508 366/293 |

FOREIGN PATENT DOCUMENTS

| | | | |
|---|---|---|---|
| SU | 306174 | A1 | 8/1971 |
| WO | 2015/001385 | A1 | 1/2015 |

* cited by examiner

INTEGRATED ROTARY MIXER AND DISPERSER HEAD

CROSS-REFERENCE TO RELATED APPLICATION(S)

This application is a continuation of currently pending international application No. PCT/IB2013/055454 having an international filing date of Jul. 3, 2013 and designating the United States. The aforementioned international application is incorporated herein in its entirety.

TECHNICAL FIELD

The present invention pertains to an integrated rotary mixer and disperser head for operations such as dispersing, dissolving, emulsifying, and blending of solids, liquids, or gases with other liquids, and more particularly of the type comprising a slotted mixing chamber with a shaft adapted to be connected to a rotatable drive shaft.

The mixer and disperser head according to the invention is particularly useful in the food-processing industry, the chemical industry, the pharmaceutical industry, and other branches of industry for dispersing and dissolving of solids and semi-solids in liquids.

BACKGROUND

A mixer head for such purposes is shown in FIGS. 1 and 2 of U.S. Pat. No. 3,170,638. This mixer head has a mixing chamber comprising two sections in the form of truncated cones; one at each end of a cylindrical middle section which is slotted along its periphery, and a central shaft extends through the mixer head. The conical sections act as centrifugal pumps pumping the substances to be mixed into the cylindrical section, where in a first stage they undergo a hydraulic shear where the two streams meet. The slots in the middle section act in a second stage as specific shear elements, while a third shear stage occurs when the radial discharge from the head meets the slower moving contents of the mixing vessel. The shear forces act to mix the substances and in particular to disperse and dissolve solids in the fluid mixture.

Mixer heads of this type present several disadvantages. Thus, for a given diameter of the mixing chamber and a given rotational speed, the throughput is delimited by the smaller cross-sectional inlet areas of the conical sections. Further, in acting as centrifugal pumps, the conical sections impart to the substances to be mixed a considerable tangential component of velocity, which rather than contributing to the hydraulic shear detracts therefrom. The central shaft extending through the mixing chamber reduces the volume thereof, and thereby the retention time therein for the fluid mixture. Finally, such mixer heads are not immediately accessible for ocular inspection after a cleaning-in-place procedure (CIP-procedure) due to the presence of the conical sections and the thoroughgoing shaft.

Another mixer and disperser head is shown in FIGS. 1-3 of U.S. Pat. No. 4,900,159. In this mixer head, a pair of impellers is clamped to each end of a generally cylindrical mixing chamber by means of a shoulder and a nut on a shaft extending through a bore in a central hub in the mixing chamber. The mixing chamber has a plurality of axially extending slots in its peripheral wall, which is connected to the central hub by means of a radial flange placed in the middle of the mixing chamber and as a partition separating that in two chambers. Also, in this mixer head the central hub and the flange will reduce the volume of the mixing chambers and thereby the retention time therein for the fluid mixture, and the same parts will likewise impart a rotational velocity to the substances to be mixed, i.e., a tangential component of velocity, which will detract from the shear imparted to the fluid mixture when discharged through the elongated slots. The flange or partition prevents that the two streams from the opposite ends of the mixing head meet and thereby undergo a hydraulic shear. This known mixer head is completely unsuited for a CIP-procedure, partly because of the many inaccessible corners therein, where particulate matter or substances with high viscosity or adhesiveness may accumulate, and partly because of the impellers clamped flatly on to the ends of the cylindrical mixing chamber making an ocular inspection of the inner of the mixing head practically impossible. In fact a thorough cleaning of this known mixer and disperser head will necessitate a complete disassembling of the head, separate cleaning of each of its parts, and reassembling thereof again.

From the applicant's own prior patent U.S. Pat. No. 5,407,271 is known a rotary mixer and disperser head, which alleviates most of the above-mentioned disadvantages. This mixer head consists of a shaft to which is connected a mixing chamber that is to be disposed into a vat or the like for dispersing, dissolving or blending of solids liquids or gasses with other liquids. The mixing chamber has secured to its upper and lower ends a plurality of impeller blades that have an end thereof located outside the mixing chamber to direct material into the mixing chamber and out through openings in the side wall of the mixing chamber during the mixing and dispersing thereof. The shaft for rotating the mixing chamber is merely located at one end thereof and does not extend into the mixing chamber, and thus does not impede the mixing action taking place within it. The specific location of the blades, their relationship relative to the mixing chamber, and their configuration provide for a very efficient mixing operation. However, it has been observed that during operations under difficult conditions, where the load has been high, the weldings between the first impeller blades and the peripheral wall of the mixing chamber tend to break.

SUMMARY

It is thus an object of the present invention to provide a more robust mixer and disperser head.

It is a further object of the invention to provide a mixer and disperser head exerting improved hydraulic and mechanical shears to the substances to be mixed or dispersed.

It is a further object of the invention to provide a mixer and disperser head with improved operational energy efficiency.

According to the present invention, the above-mentioned and other objects are fulfilled by an integrated rotary mixer and disperser head comprising:

a drive shaft configured to be connected to a drive motor, a hollow cylindrical mixing chamber coaxial with and rigidly connected to the drive shaft and having through its peripheral wall a plurality of discharge openings, a first plurality of equally angularly spaced impeller blades at one axial end of said mixing chamber, each of said first plurality of impeller blades having a leading edge situated completely outside the mixing chamber and disposed axially outside for said one end, and a trailing portion having a trailing edge disposed axially inward for said leading edge, a second plurality of equally angularly spaced impeller blades at the other axial end of said mixing chamber, each of said second plurality of impeller blades having a leading edge situated completely outside the mixing chamber and disposed axially outside for said other end, and a trailing portion having a trailing edge disposed axially inward for said leading edge, the leading edge of each of said first plurality of impeller blades forming part of a first shear part, the radially inner end thereof being rigidly connected to said drive shaft and the radially outer end thereof being rigidly connected to said one axial end of the mixing chamber, the leading edge of each of said second plurality of impeller blades forming part of a second shear part, the radially inner end thereof being rigidly connected to said drive shaft and the radially outer end thereof being rigidly connected to said other axial end of the mixing chamber, a plurality of equally angularly spaced shear arms situated completely outside the mixing chamber and radially extending from said drive shaft, the radially inner end of each of said plurality of equally spaced shear arms being rigidly connected to said drive shaft, and the radially outer end of each of said plurality of equally spaced shear arms being rigidly connected to a respective one of the radially outer end of one of the first shear part, each of said shear arms having a sharpened leading edge and a trailing edge.

By this construction of the mixer and disperser head, the shaft is disposed entirely outside the mixing chamber and only rigidly connected to the radially inner ends of the first plurality of impeller blades. Due to the absence of the shaft from the mixing chamber, this has a maximum volume providing for an optimum retention time for the fluid medium therein, and the shaft can of course not impart any rotational movement to that medium. The particular design of the impeller blades impart to the inflow from each end of the mixing chamber an inwardly directed thrust and a high velocity having a predominating axial component thereby creating an intense hydraulic shear in the fluid mixture while at the same time imparting a high mechanical shear thereto. This particular design also allows for an ocular inspection of the inner parts of the mixer and disperser head, and the integral one-piece construction thereof leaves no corners wherein polluting matter may accumulate so that the inventive mixer and disperser head is well suited for a CIP-procedure.

Furthermore, by providing a plurality of equally angularly spaced shear arms being situated completely outside the mixing chamber and radially extending from said drive shaft, and connected to the drive shaft and the shear parts as described above, a very robust mixer and disperser head is achieved, wherein the connections between the radially outer end of the first shear parts and the one end of the mixing chamber are reinforced, thus precluding breakage.

Moreover, since the leading edge of the shear arms is sharpened, it will during use cut through the material as it is being pulled into the mixing chamber by the first plurality of impeller blades. This cutting action reduces large agglomerates in the material and therefore effectively provides an initial coarse shear zone in addition to the shear zone provided by the mixing chamber with the plurality of discharge openings in its peripheral wall, thereby providing a mixer and disperser head exerting improved hydraulic and mechanical shear to the substances to be mixed or dispersed.

This also has the effect that the mixing process takes less time with a mixer and disperser head according to the invention and it is subjected to less stress and wear, and hence causing improved operational energy efficiency.

The different parts of the mixer and disperser head may readily be manufactured from stock materials such as tubing and sheet materials by simple technological processes such as turning, milling, punching, and stamping, and assembled by joining processes such as welding or adhesive bonding. In a preferred embodiment of the integrated rotary mixer and disperser head according to the invention the leading edge of each of said first plurality of impeller blades is sharpened, thereby providing further increased shear to the substances to be mixed or dispersed.

In a preferred embodiment of the integrated rotary mixer and disperser head according to the invention the leading edge of each of said second plurality of impeller blades is sharpened, thereby providing further increased shear to the substances to be mixed or dispersed.

In a preferred embodiment, leading edge of each of said first and second plurality of impeller blades is sharpened. Hereby is provided a second shear zone surrounding the primary shear zone provided by the mixing chamber.

The overall effect is the ability to process larger solids, and the ability to produce equal emulsion droplets as well as dispersions in less time, thereby allowing a greatly increased capacity and output.

In a further preferred embodiment of the integrated rotary mixer and disperser head according to the invention each of the first shear parts of the first plurality of impeller blades comprises a leading portion extending in a plane substantially perpendicular to the drive shaft, and a peripheral portion bent about 90 degrees inward from said leading portion.

In a further preferred embodiment of the integrated rotary mixer and disperser head according to the invention the trailing portion of each of said first plurality of impeller blades is integral with and forming an obtuse angle with said leading portion of each of the first impeller blades and in a plane projection having the shape of a sector of an annulus.

In a further preferred embodiment of the integrated rotary mixer and disperser head according to the invention each of the second shear parts of the second plurality of impeller blades comprises a leading portion extending in a plane substantially perpendicular to the drive shaft, and a peripheral portion bent about 90 degrees inward from said leading portion.

In a further preferred embodiment of the integrated rotary mixer and disperser head according to the invention the trailing portion of each of said second plurality of impeller blades is integral with and forming an obtuse angle with said leading portion of each of said second impeller blades and in a plane projection having the shape of a sector of an annulus.

In a further preferred embodiment of the integrated rotary mixer and disperser head according to the invention, at least some of said first and second pluralities of impeller blades have formations for creating turbulence or shear in a fluid mixture passing over them.

In a further preferred embodiment of the integrated rotary mixer and disperser head according to the invention, said formations are serrations at the trailing edge of said impeller blades.

In a further preferred embodiment of the integrated rotary mixer and disperser head according to the invention, said serrations have a generally castellation-like profile.

In a further embodiment of the integrated rotary mixer and disperser head according to the invention each of the shear arms comprises a leading portion extending in a plane substantially perpendicular to the drive shaft, and a peripheral portion bent about 90 degrees inward from said leading portion.

In a further preferred embodiment of the integrated rotary mixer and disperser head according to the invention each of the shear arms comprises a leading portion extending in a plane substantially perpendicular to the drive shaft, a middle portion bent inward from the leading portion, thereby forming an obtuse angle relative to said leading portion, and a peripheral portion bent inward from said middle portion, whereby said peripheral portion forms an obtuse angle relative to said middle portion, such that the peripheral portion is parallel to the peripheral wall of the mixing chamber.

In a further embodiment of the integrated rotary mixer and disperser head according to the invention, only the leading edge of said middle portion is sharpened.

In a further preferred embodiment of the integrated rotary mixer and disperser head according to the invention the obtuse angle β, which the trailing portion of each of said first plurality of impeller blades forms with said leading portion of each of the first impeller blades is between 105 degrees and 175 degrees, preferably between 125 degrees and 155 degrees. Different degrees have been tested in 3D and Computational Fluid Dynamic simulation tests as well as live testing in fluid and solid slurries, and it turns out that between 125 degrees and 165 degrees provides the best results, with a maximal effect at an angle of approximately 135 degrees, which is the preferred angle.

In a further preferred embodiment of the integrated rotary mixer and disperser head according to the invention, the obtuse angle, which the trailing portion of each of said second plurality of impeller blades forms with said leading portion of each of the second impeller blades is between 105 degrees and 175 degrees, preferably between 125 degrees and 155 degrees, where 135 degrees is preferred, because similar 3D simulation tests suggest that an angle between 125 degrees and 165 degrees provides the best results, with a maximal effect at an angle of approximately 135 degrees, which is the preferred angle.

In a further preferred embodiment of the integrated rotary mixer and disperser head according to the invention, the obtuse angle β, which the trailing portion of each of said first plurality of impeller blades forms with said leading portion of each of the first impeller blades, is equal to the obtuse angle that the trailing portion of each of said second plurality of impeller blades forms with said leading portion of each of the second impeller blades.

In an embodiment of the integrated rotary mixer and disperser head according to the invention the discharge openings are a plurality of round or oval openings distributed evenly throughout the peripheral wall of the mixing chamber.

In a further preferred embodiment of the integrated rotary mixer and disperser head according to the invention the discharge openings are a plurality of elongated, equally angularly spaced slots.

In a further embodiment of the integrated rotary mixer and disperser head according to the invention the plurality of elongated slots extends in a generally axial direction of the mixing chamber.

In a further preferred embodiment of the integrated rotary mixer and disperser head according to the invention the plurality of elongated slots extends in a direction forming an angle α of between 5 degrees and 55 degrees with the generally axial direction of the mixing chamber, preferably an angle α of between 25 degrees and 55 degrees with the generally axial direction of the mixing chamber, even more preferably an angle α of between 35 degrees and 55 degrees with the generally axial direction of the mixing chamber, yet even more preferably an angle α of between 40 degrees and 50 degrees with the generally axial direction of the mixing chamber. 3D simulation tests show that an angle α of between 5 degrees and 55 degrees with the generally axial direction of the mixing chamber is the most effective. However, the same tests also show an increased effect at an angle α of approximately 45 degrees, which therefore is the preferred angle α. The 3D and CFD simulation as well as live tests indicate that at this angle α of 45 degrees, the slots cut through the flowing material like a knife.

In a further preferred embodiment of the integrated rotary mixer and disperser head according to the invention the trailing edge of each of said plurality of slots through the peripheral wall of said mixing chamber forms an acute angle θ with the tangent to the inside of said wall at the point of intersection.

In a further embodiment of the integrated rotary mixer and disperser head according to the invention, the various parts are made from a metallic material such as stainless steel and rigidly connected to each other by welding so as to form an integral one-piece unit.

BRIEF DESCRIPTION OF THE DRAWINGS

A further understanding of the nature and advantages of the present invention may be realized by reference to the remaining portions of the specification and the drawings. In the following, preferred embodiments of the invention are explained in more detail with reference to the drawings, wherein.

DETAILED DESCRIPTION OF THE PREFERRED EMBODIMENTS

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. Like reference, numerals refer to like elements throughout. Like elements will, thus, not be described in detail with respect to the description of each figure.

Figure 1:
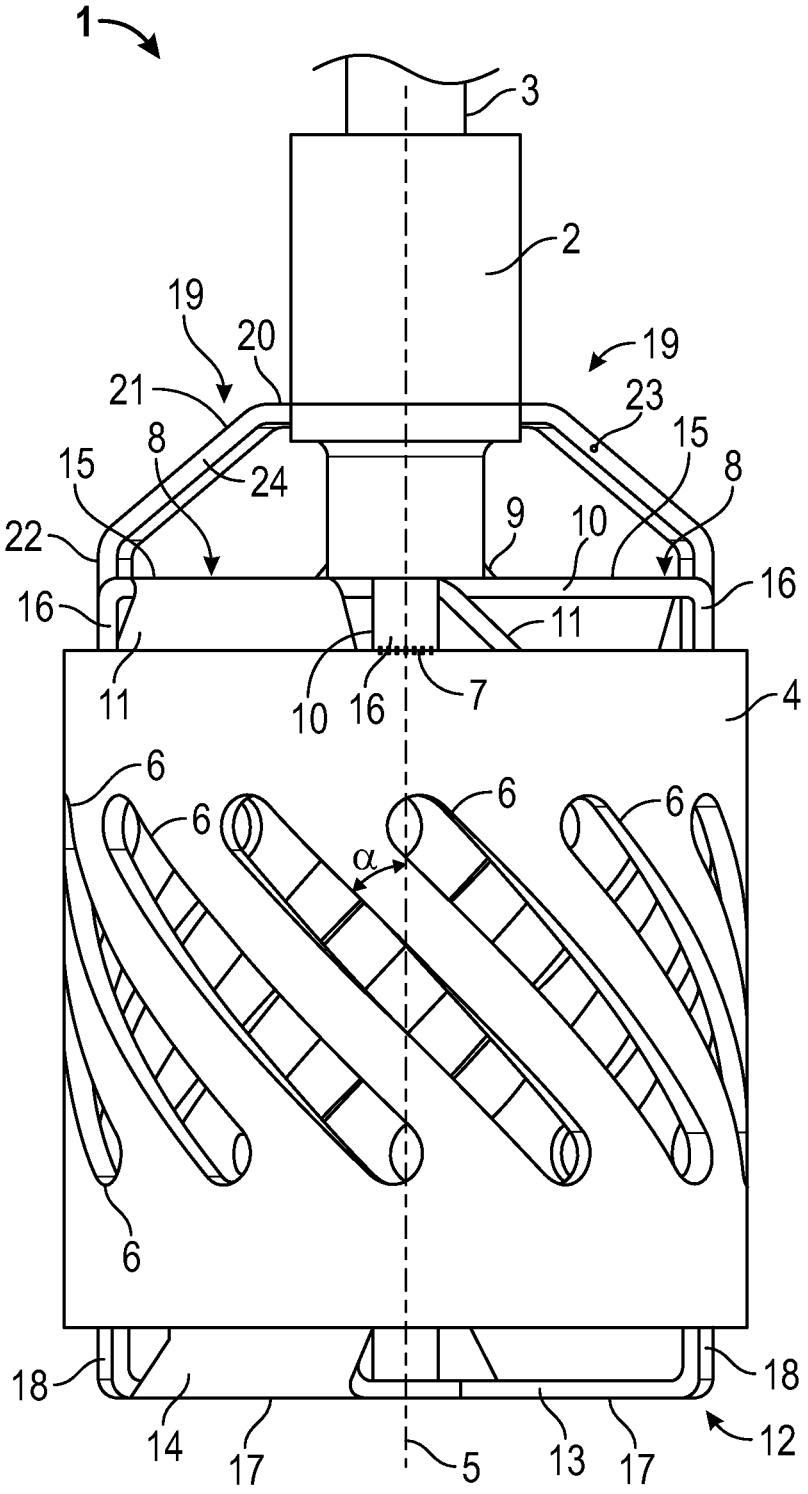
FIG. 1 shows an embodiment of a mixer and disperser head according to the invention.

FIG. 1 shows an embodiment of an integrated rotary mixer and disperser head 1. The illustrated mixer and disperser head 1 comprises a drive shaft 2 configured to be connected to a drive motor (not shown) via a connecting shaft 3. The mixer and disperser head 1 comprises a tubular cylindrical mixing chamber 4 preferably made of stainless steel and having a circular cross section and a central axis 5. The cylindrical mixing chamber 4 is coaxial with and rigidly connected to the drive shaft 2. Spaced equally angularly through the peripheral wall of the mixing chamber 4 in the middle region thereof are provided a plurality of discharge openings. The plurality of discharge openings is embodied as elongated slots 6. The plurality of elongated slots 6 extends in a direction forming an angle $\alpha$ of 45 degrees with the generally axial direction 5 of the mixing chamber 4.

In other embodiments of the integrated rotary mixer and disperser head according to the invention the plurality of elongated slots may extends in a direction forming an angle $\alpha$ of between 5 degrees and 55 degrees with the generally axial direction 5 of the mixing chamber, preferably an angle $\alpha$ of between 25 degrees and 55 degrees with the generally axial direction of the mixing chamber, even more preferably an angle $\alpha$ of between 35 degrees and 55 degrees with the generally axial direction of the mixing chamber, yet even more preferably an angle $\alpha$ of between 40 degrees and 50 degrees with the generally axial direction of the mixing chamber.

Connected to the upper planar rim of mixing chamber 4 by weldings such as at 7 is a first set of impeller blades 8 preferably made of stainless steel. The first set of impeller blades 8 are connected to the drive shaft 2 by welding such as at 9. The first plurality of equally angularly spaced impeller blades 8 are placed at one axial end of the mixing chamber 4, and each of said first plurality of impeller blades 8 have a leading edge 10 situated completely outside the mixing chamber 4 and disposed axially outside for said one end, and a trailing portion 11 having a trailing edge disposed axially inward for said leading edge 10.

Connected to the lower rim of the mixing chamber 4 is a second plurality of equally angularly spaced impeller blades 12 at the other axial end of said mixing chamber 3. Each of said second plurality of impeller blades 12 have a leading edge 13 situated completely outside the mixing chamber 4 and disposed axially outside for said other end, and a trailing portion 14 having a trailing edge disposed axially inward for said leading edge 13.

The leading edge 10 of each of said first plurality of impeller blades 8 forms part of a first shear part, the radially inner end thereof being rigidly connected to said drive shaft 2, e.g. by welding at 9 and the radially outer end thereof being rigidly connected to said one axial end of the mixing chamber 4. In the illustrated embodiment each of the first shear parts of the first plurality of impeller blades 8 comprises a leading portion 15 extending in a plane substantially perpendicular to the drive shaft 2, and a peripheral portion 16 bent about 90 degrees inward from said leading portion 15.

The leading edge 13 of each of said second plurality of impeller blades 12 forms part of a second shear part, the radially inner end thereof being rigidly connected to hub-like central disc (see FIGS. 5 and 7), e.g. by welding, and the radially outer end thereof being rigidly connected to said other axial end of the mixing chamber 4. In the illustrated embodiment each of the second shear parts of the second plurality of impeller blades 12 comprises a leading portion 17 extending in a plane substantially perpendicular to the drive shaft 2, and a peripheral portion 18 bent about 90 degrees inward from said leading portion 17.

The illustrated embodiment of a mixer and disperser head 1 further comprises a plurality of equally angularly spaced shear arms 19 situated completely outside the mixing chamber 4 and radially extending from said drive shaft 2. Each of the shear arms 19 comprises a leading portion 20 extending in a plane substantially perpendicular to the drive shaft 2, and a middle portion 21 bent inward from the leading portion 20, the middle portion thereby forming an obtuse angle relative to said leading portion 20. Each of the shear arms 10 further comprises a peripheral portion 22 bent inward from said middle portion 21, whereby said peripheral portion 22 forms an obtuse angle relative to said middle portion 21, such that the peripheral portion 22 is parallel to the peripheral wall of the mixing chamber 4. The radially inner end of each of said plurality of equally spaced shear arms 19 is rigidly connected to said drive shaft 2, e.g. by welding, and the radially outer end of each of said plurality of equally spaced shear arms 19 is rigidly connected to a respective one of the radially outer end of one of the first shear part 15. Each of said shear arms 19 has a leading edge 23 and a trailing edge 24.

Figure 2:
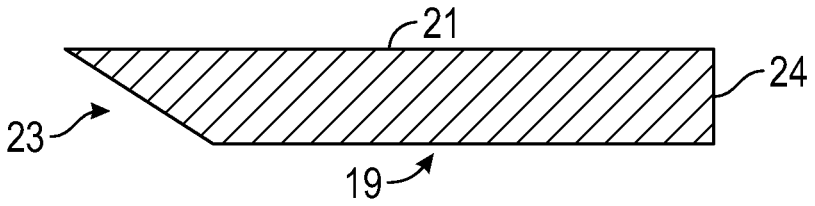
FIG. 2 shows a cross section of an embodiment of a middle portion of a shear arm.

FIG. 2 shows a cross section of a middle portion 21 of a shear arm 19, where it is more clearly seen that the leading edge 23 of the middle portion 21 of the shear arm 19 is sharpened, like a scissor.

Figure 3:
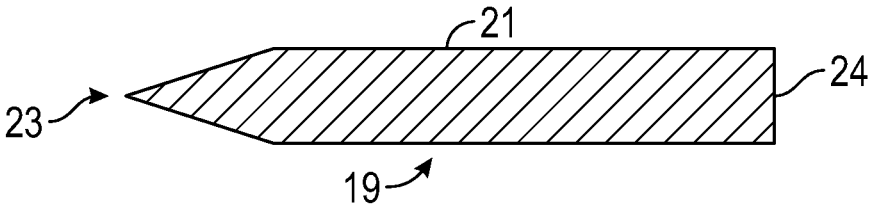
FIG. 3 shows a cross section of another embodiment of a middle portion of a shear arm.

FIG. 3 shows a cross section of an alternative embodiment of a middle portion 21 of a shear arm 19 where it is seen that the leading edge 23 of the middle portion 21 of the shear arm 19 is sharpened like a knife blade.

By providing a plurality of equally angularly spaced shear arms 19 situated completely outside the mixing chamber 4 and radially extending from said drive shaft 2, and connected to the drive shaft 2 and the shear parts as described above, a very robust mixer and disperser head 1 is achieved, wherein the connections between the radially outer end of the first shear parts and the one end of the mixing chamber, e.g. at the welding 7, is reinforced, thus precluding breakage.

Moreover, since the leading edge 23 of the shear arms 19 is sharpened as shown in FIG. 2 or 3, it will during use cut through the material as it is being pulled into the mixing chamber 4 by the first plurality of impeller blades 8. This cutting action reduces large agglomerates in the material and therefore effectively provides an initial coarse shear zone in addition to the shear zone provided by the mixing chamber 4 with the plurality of discharge openings 6 in its peripheral wall, thereby providing a mixer and disperser head 1 exerting improved hydraulic and mechanical shear to the substances to be mixed or dispersed.

This also has the effect that the mixing process takes less time with a mixer and disperser head 1 according to the invention and it is subjected to less stress and wear, and hence gives improved operational energy efficiency.

The leading edge 10, 13 of each of said first and second plurality of impeller blades 8, 12 is sharpened, for example in the same way as the shear arm 19 is sharpened, preferably as illustrated in FIG. 2, or alternatively as in FIG. 3. Hereby is provided a second shear zone surrounding the primary shear zone provided by the mixing chamber 4.

The overall effect is the ability to process larger solids, and the ability to produce equal emulsion droplets in less time, thereby allowing a greatly increased capacity and output.

Figure 4:
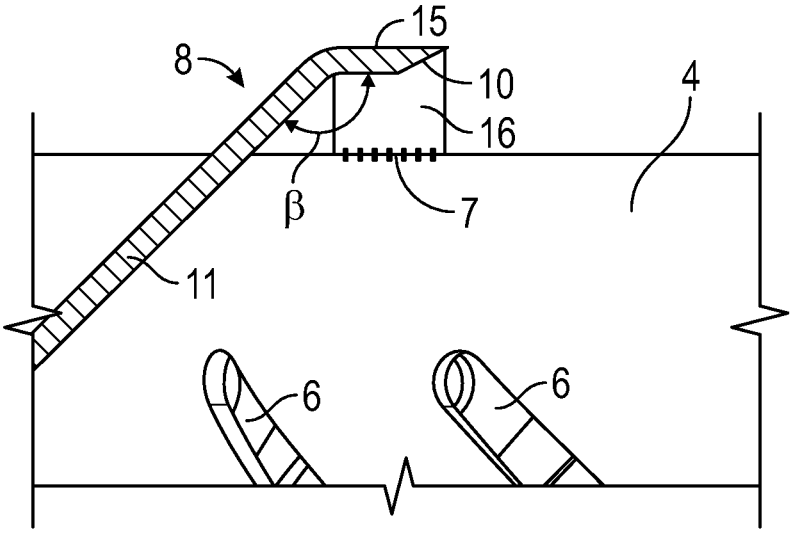
FIG. 4 shows a cross section of an embodiment of a mixer and disperser head according to the invention.

FIG. 4 shows a cross section of a mixer and disperser head 1 according to the invention, where it is clearly visible that the trailing portion 11 of each of said first plurality of impeller blades 8 is integral with and forming an obtuse angle β with said leading portion 15 of each of the first impeller blades 8. This obtuse angle β, which the trailing portion 11 of each of said first plurality of impeller blades 8 forms with said leading portion 15 of each of the first impeller blades 8 is between 105 degrees and 175 degrees, preferably between 125 degrees and 155 degrees. Different degrees have been tested in 3D simulation tests and it turns out that an angle β between 125 degrees and 165 degrees provides best results, with a maximal effect at an angle β of approximately 135 degrees, which therefore is the preferred angle β.

Figure 5:
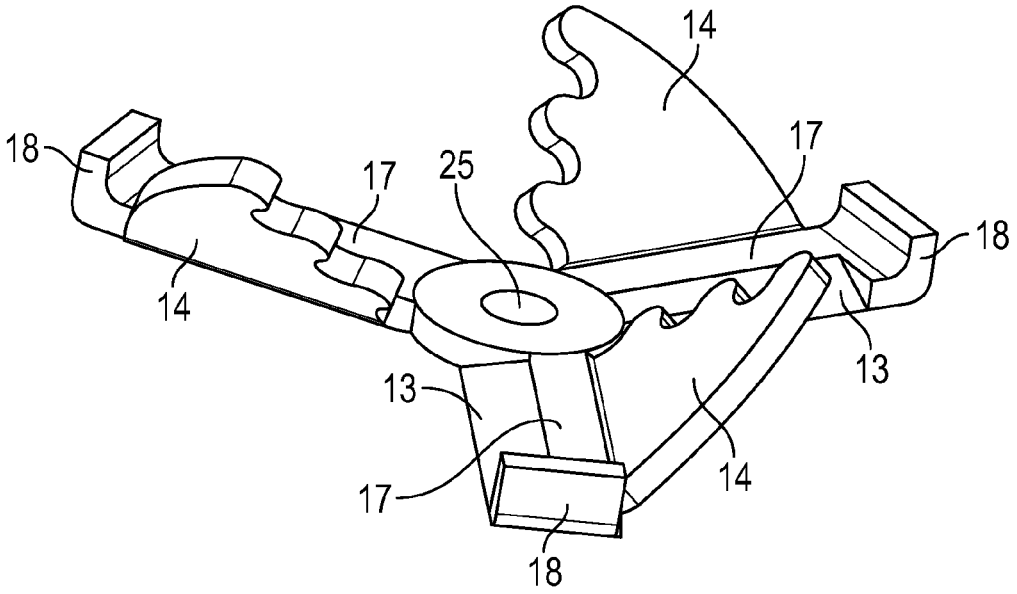
FIG. 5 shows a perspective view of an embodiment of the second plurality of impeller blades.

FIG. 5 shows a perspective view of an embodiment of the second plurality of impeller blades 12, where it is seen that the trailing portion 14 of each of said second plurality of impeller blades 12 is integral with and forming an obtuse angle with said leading portion 17 of each of said second impeller blades 12 and in a plane projection having the shape of a sector of an annulus. The radially inner end of the leading portions 17 is rigidly connected to hub-like central disc 25, e.g. by welding, and the radially outer end thereof is configured for being rigidly connected to the other axial end of the mixing chamber 4. In the illustrated embodiment each of the leading portions 17 extends in a plane substantially perpendicular to the drive shaft 2, and a have peripheral portion 18 bent about 90 degrees inward from said leading portion 17. This peripheral portion is rigidly connected to the other axial end of the mixing chamber 4 by, for example, welding. In this embodiment, only three second impeller blades 12 are illustrated; however, the number of impeller blades will vary and may be chosen in accordance with the particular need.

Preferably, the obtuse angle β, which the trailing portion 11 of each of said first plurality of impeller blades 8 forms with said leading portion 15 of each of the first impeller blades 8 is equal to the obtuse angle, which the trailing portion 14 of each of said second plurality of impeller blades 12 forms with said leading portion 17 of each of the second impeller blades 12.

As may be seen in FIG. 4 and FIG. 5, the leading edges 10 and 13 of the first and second set of impeller blades may have sharpened edges which are differently angled, i.e. have different sharpness. However, in a preferred embodiment these sharpened leading edges of the first and second set of impeller blades are identical. Furthermore, in another preferred embodiment the sharpened edge 23 of a shear arm 19 may also be equal to the sharpness of the leading edges 10, 13 of the first and second impeller blades.

Figure 6:
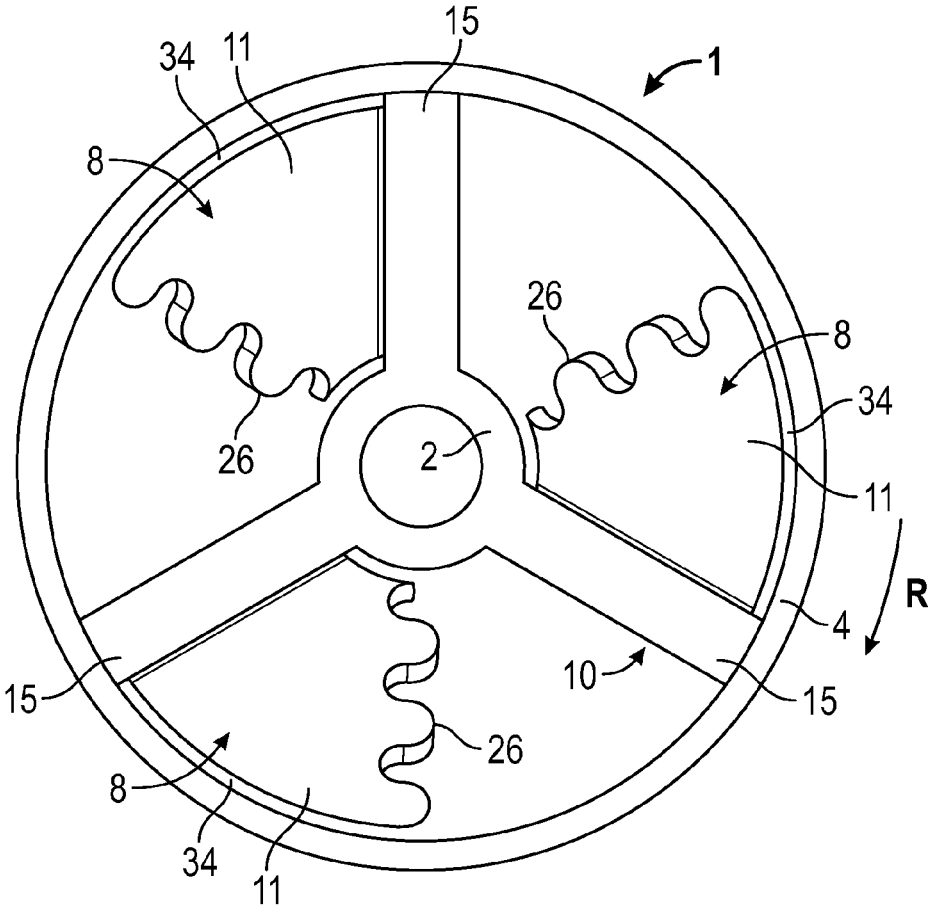
FIG. 6 shows an embodiment of a mixer and disperser head as seen from above.

FIG. 6 shows an embodiment of an integrated rotary mixer and disperser head 1 as seen from above, wherein the rotational direction is illustrated with the arrow R. As illustrated, the trailing edge of the impeller blades 8 is provided with serrations 26 that have a generally castellation-like profile. This castellation-like profile of the serrations 26 will create turbulence or shear in a fluid mixture passing over them. In the illustrated embodiment there is provided a gap 34 between the trailing portions 11 of the first plurality of impeller blades 8 and the cylindrical wall of the mixing chamber 4. This enables an easier and more accurate cleaning of the disperser and mixer head 1, especially the inner surface of the cylindrical wall of the mixing chamber 4.

Figure 7:
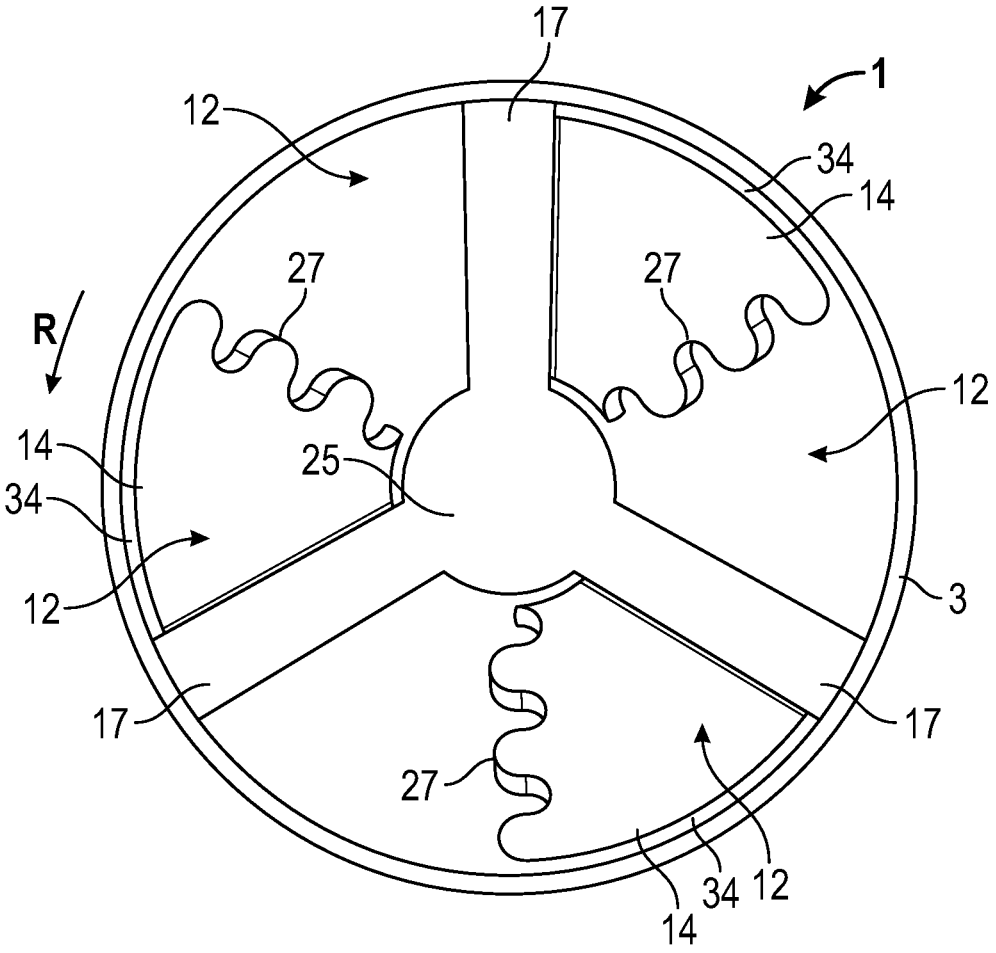
FIG. 7 shows an embodiment of a mixer and disperser head as seen from below.

Similarly, FIG. 7 shows an embodiment of an integrated rotary mixer and disperser head 1 as seen from below, wherein the rotational direction is illustrated with the arrow R. As illustrated, the trailing edge of the impeller blades 12 is provided with serrations 27 that have a generally castellation-like profile. This castellation-like profile of the serrations 27 will also create turbulence or shear in a fluid mixture passing over them. Similarly to what is shown in FIG. 6 there may also be provided a gap 34 between the trailing portions 14 of the second plurality of impeller blades 12 and the cylindrical wall of the mixing chamber 4. This also enables an easier and more accurate cleaning of the disperser and mixer head 1, especially the inner surface of the cylindrical wall of the mixing chamber 4.

Figure 8:
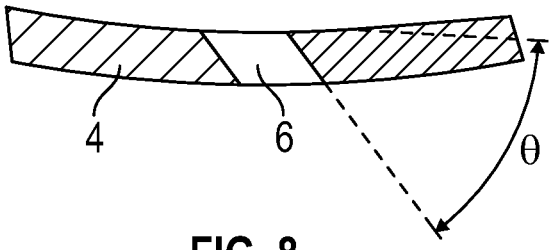
FIG. 8 shows a cross of an embodiment of a mixing chamber.

FIG. 8 shows a cross section of the peripheral wall of the mixing chamber 4. As illustrated, the trailing edge of each of the plurality of slots 6 through the peripheral wall of the mixing chamber 4 forms an acute angle θ with the tangent to the inside of said wall at the point of intersection. This feature contributes to the shear forces introduced into the fluid mixture expelled through slots 6. The trailing edges of the slots 6 so formed also enhance the centrifugal pumping action of the mixing chamber 4 by increasing the velocity by which the fluid mixture is expelled from the mixing chamber 4 into the liquid mixture in the surrounding vessel thereby also increasing the hydraulic shear obtained thereby.

From the foregoing description of the first and second sets of impeller blades 8 and 12, respectively, it is to be understood that they may be made from flat sheet metal by punching using the same set of dies, and by bending trailing portions 11, 14 and bent portions 16, 18 to one side to obtain a set of impeller blades 8, 12 and trailing portions 11, 14 and bent portions 16, 18.

Figure 9:
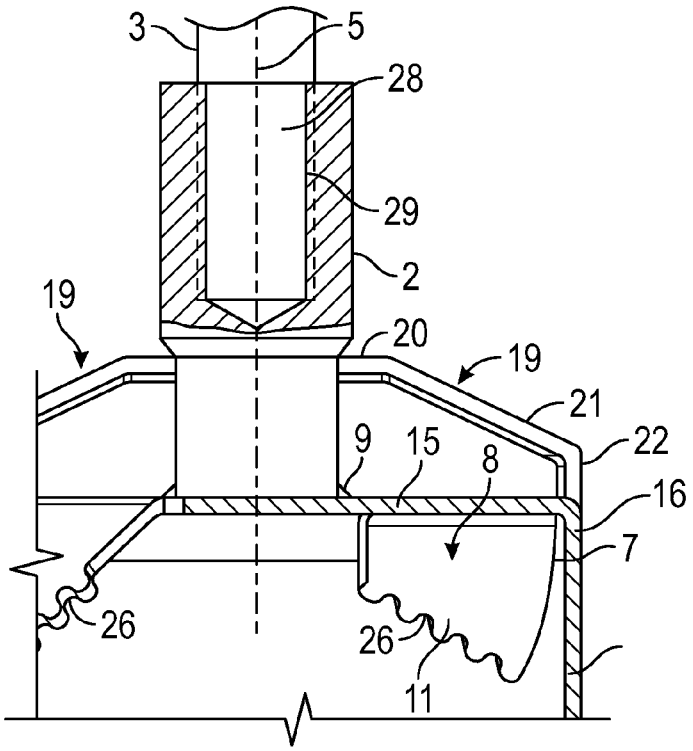
FIG. 9 shows a cross section of an embodiment of a mixer and disperser head according to the invention.
Figure 10:
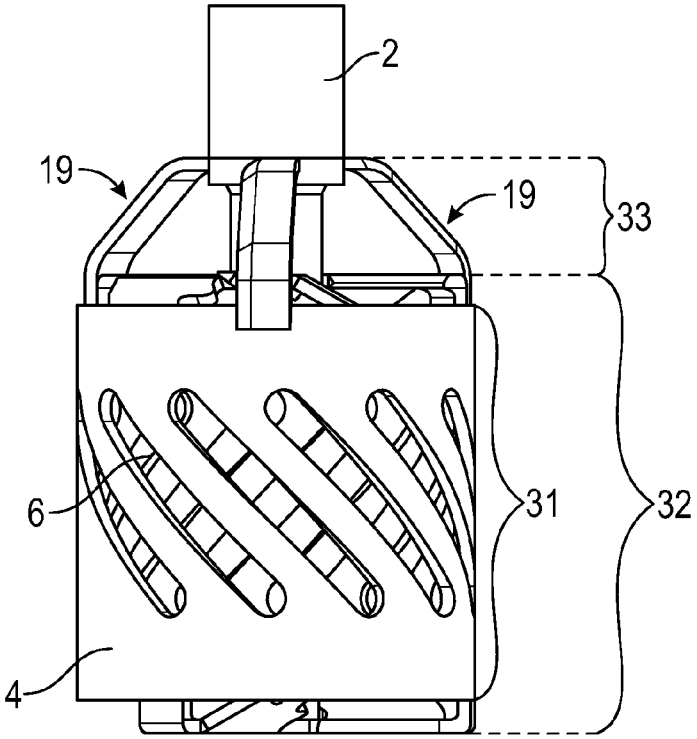
FIG. 10 shows an embodiment of a mixer and disperser head according to the invention, where the different shear zones are indicated.

As shown in FIG. 9, the drive shaft 2 has a central bore 28 provided with an internal thread 29 adapted to be threadingly engaged with a corresponding external thread on a connecting shaft 3 connected to a drive unit such as an electric motor or a hydraulic or pneumatic motor for rotatably driving the mixer and disperser head 1.

When thus connected to a drive unit the mixer and disperser head 1 is immersed into the substances to be mixed and/or dispersed contained in a suitable vessel and caused to rotate at high RPM.

The first and second plurality of impeller blades 8 and 12, respectively, now act as impeller pumps driving the substances from the surrounding vessel in a mainly axial direction (along the axis 5 of the mixing chamber 4) into the mixing chamber 4 at a great velocity. Thereby these substances firstly undergo an abrupt change of relative direction of movement, resulting in the introduction of accelerative shear forces therein, and secondly the flowing substances are further split up by the castellated serrations 26 and 27, respectively, introducing further turbulence and shear therein. Within the mixing chamber 4, the two streams of substances collide substantially axially at high velocities creating a high hydraulic shear. Due to the absence of a high speed rotating shaft within the mixing chamber 4, there is no rotative force in the center of the mixing chamber 4 acting upon the substances. Therefore, the greater part of the substances will move toward the periphery in a mainly non-rotative, radial direction where these substances are expelled through the discharge slots 6. The high speed rotating slots 6 act upon the slower moving substances with high mechanical shear, and the substances are expelled therefrom with high velocity into the surrounding mixture, whereby they undergo further high hydraulic shear.

Since the shear arms 19 are provided with sharpened leading edges 23 and each of the first and second plurality of impeller blades 8 and 12 are also provided with sharpened leading edges 10 and 13, two additional shear zones 32 and 33 are effectively introduced, as compared with the initially mentioned prior art mixer head disclosed in e.g. U.S. Patent No. 5,407,271. In addition to the primary shear zone 31 provided by the mixing chamber 4 and its slots 6, the sharpened leading edges 10 and 13 of the first and second plurality of impeller blades 8 and 12 will provide a second shear zone 32, because these leading edges 10 and 13 will also cut through the substances and provide additional shear to these substances when they enter the mixing chamber 4. By further providing sharpened leading edges 23 on the shear arms 19 a third, initial shear zone 33 is provided, wherein larger conglomerates and particles may be sheared and broken down, before being sucked into the mixing chamber 4 by the first plurality of impeller blades 8. This means that shear forces are introduced in the fluid mixtures in at least three further stages, defined by the leading edges 10 and 13 of the first and second plurality of impeller blades and the leading edges 23 of the shear arms, further in the primary stage 31, which is intensified due to the angle formed by the slots 6 make relative to the generally axial direction of the mixing chamber 4. The overall effect of this is an improved overall performance of approximately 20%.

Since the visibility of the inner surfaces of the mixer and disperser head 1 according to the invention is only slightly obscured by the presence of the two sets of impeller blades 8 and 12, respectively, the inventive mixer and disperser head lends itself to an ocular inspection after a CIP-procedure.

From the foregoing description it will be understood that the various parts of the mixer and disperser head according to the invention may be manufactured at a low cost by simple technological processes and interconnected by welding so as to form an integrated one-piece unit.

While the foregoing description relates to the preferred embodiment, it will be understood that numerous modifications may be incorporated therein without departing from the inventive concept. Thus, the discharge openings may have any other appropriate shape than that of elongated slots 6, and also the impeller blades 8 and 12 may be present in another number than three for each set of impeller blades 8, 12 and may have another shape than that described. Depending on the intended application of the mixer and disperser head 1 it may also be made from other materials than stainless steel, e.g. from plastics materials, or from a combination of plastics materials and metallic materials, and the various parts of the mixer and disperser head 1 may be rigidly connected to each other by other means than welding, e.g. by adhesive bonding.

LIST OF REFERENCE NUMBERS

In the following is given a list of reference numbers that are used in the detailed description of the invention.

1 rotary mixer and disperser head,
2 drive shaft,
3 connecting shaft,
4 mixing chamber,
5 cylindrical axis of the mixing chamber,
6 elongated slots,
7 welding between peripheral portion 16 of the first shear parts,
8 one of the first impeller blades,
9 welding between the leading portion of the first shear part,
10 leading edge of the first impeller blades,
11 trailing portion of the first impeller blades,
12 one of the second plurality of impeller blades,
13 leading edge of the second impeller blades,
14 trailing portion of the second impeller blades,
15 leading portion of the first impeller blades,
16 peripheral portion of the first impeller blades,
17 leading portion of the second impeller blades,
18 peripheral portion of the second impeller blades,
19 shear arms,
20 leading portion of shear arm,
21 middle portion of shear arm,
22 peripheral portion of shear arm,
23 leading edge of shear arm,
24 trailing edge of shear arm,
25 hub-like annular disk connecting the leading portions of the second impeller blades,
26 castellated serrations of the first impeller blades,
27 castellated serrations of the second impeller blades,
28 central bore of the drive shaft,
29 internal thread in the bore of the drive shaft,
31 primary shear zone,
32 secondary shear zone,
33 initial shear zone, and
34 gap between impeller blades and the cylindrical wall of the mixing chamber.

What is claimed is:

1. An integrated rotary mixer and disperser head comprising:

a drive shaft configured to be connected to a drive motor, a cylindrical mixing chamber coaxial with and rigidly connected to the drive shaft and having through its peripheral wall a plurality of discharge openings, a first plurality of equally angularly spaced impeller blades at one axial end of said mixing chamber, each of said first plurality of impeller blades having a leading edge situated completely outside the mixing chamber and disposed axially outside for said one end, and a trailing portion having a trailing edge disposed axially inward for said leading edge, a second plurality of equally angularly spaced impeller blades at the other axial end of said mixing chamber, each of said second plurality of impeller blades having a leading edge situated completely outside the mixing chamber and disposed axially outside for said other end, and a trailing portion having a trailing edge disposed axially inward for said leading edge, the leading edge of each of said first plurality of impeller blades forming part of a first shear part, the radially inner end thereof being rigidly connected to said drive shaft and the radially outer end thereof being rigidly connected to said one axial end of the mixing chamber, the leading edge of each of said second plurality of impeller blades forming part of a second shear part, the radially outer end thereof being rigidly connected to said other axial end of the mixing chamber, a plurality of equally angularly spaced shear arms situated completely outside the mixing chamber and radially extending from said drive shaft, the radially inner end of each of said plurality of equally spaced shear arms being rigidly connected to said drive shaft, and the radially outer end of each of said plurality of equally spaced shear arms being rigidly connected to a respective one of the radially outer end of one of the first shear part, each of said shear arms having a sharpened leading edge and a trailing edge.

2. The integrated rotary mixer and disperser head according to claim 1, wherein the leading edge of each of said first plurality of impeller blades is sharpened.

3. The integrated rotary mixer and disperser head according to claim 1, wherein the leading edge of each of said second plurality of impeller blades is sharpened.

4. The integrated rotary mixer and disperser head according to claim 1, wherein each of the first shear parts of the first plurality of impeller blades comprises a leading portion extending in a plane substantially perpendicular to the drive shaft, and a peripheral portion bent about 90 degrees inward from said leading portion.

5. The integrated rotary mixer and disperser head according to claim 4, wherein the trailing portion of each of said first plurality of impeller blades is integral with and forming an obtuse angle with said leading portion of each of the first impeller blades and in a plane projection having the shape of a sector of an annulus.

6. The integrated rotary mixer and disperser head according to claim 5, wherein the obtuse angle β, which the trailing portion of each of said first plurality of impeller blades forms with said leading portion of each of the first impeller blades is between 105 degrees and 175 degrees, preferably between 125 degrees and 155 degrees, such as 135 degrees.

7. The integrated rotary mixer and disperser head according to claim 1, wherein each of the second shear parts of the second plurality of impeller blades comprises a leading portion extending in a plane substantially perpendicular to the drive shaft, and a peripheral portion bent about 90 degrees inward from said leading portion.

8. The integrated rotary mixer and disperser head according to claim 7, wherein the trailing portion of each of said second plurality of impeller blades is integral with and forming an obtuse angle with said leading portion of each of said second impeller blades and in a plane projection having the shape of a sector of an annulus.

9. The integrated rotary mixer and disperser head according to claim 8, wherein the obtuse angle, which the trailing portion of each of said second plurality of impeller blades forms with said leading portion of each of the second impeller blades is between 105 degrees and 175 degrees, preferably between 125 degrees and 155 degrees, such as 135 degrees.

10. The integrated rotary mixer and disperser head according to claim 8, wherein the obtuse angle, which the trailing portion of each of said first plurality of impeller blades forms with said leading portion of each of the first impeller blades is equal to the obtuse angle, which the trailing portion of each of said second plurality of impeller blades forms with said leading portion of each of the second impeller blades.

11. The integrated rotary mixer and disperser head according to claim 1, wherein at least some of said first and second pluralities of impeller blades have formations for creating turbulence or shear in a fluid mixture passing thereover.

12. The integrated rotary mixer and disperser head according to claim 11, wherein said formations are serrations at the trailing edge of said impeller blades.

13. The integrated rotary mixer and disperser head according to claim 12, wherein said serrations have a generally castellation-like profile.

14. The integrated rotary mixer and disperser head according to claim 1, wherein each of the shear arms comprises a leading portion extending in a plane substantially perpendicular to the drive shaft, and a peripheral portion bent about 90 degrees inward from said leading portion.

15. The integrated rotary mixer and disperser head according to claim 1, wherein each of the shear arms comprises a leading portion extending in a plane substantially perpendicular to the drive shaft, a middle portion bent inward from the leading portion, thereby forming an obtuse angle relative to said leading portion, and a peripheral portion bent inward from said middle portion, whereby said peripheral portion forms an obtuse angle relative to said middle portion, such that the peripheral portion is parallel to the peripheral wall of the mixing chamber.

16. The integrated rotary mixer and disperser head according to claim 15, wherein only the leading edge of said middle portion is sharpened.

17. The integrated rotary mixer and disperser head according to claim 1, wherein the discharge openings is a plurality of round or oval openings distributed evenly throughout the peripheral wall of the mixing chamber.

18. The integrated rotary mixer and disperser head according to claim 1, wherein the discharge openings include a plurality of elongated, equally angularly spaced slots.

19. The integrated rotary mixer and disperser head according to claim 18, wherein the plurality of elongated slots extends in a generally axial direction of the mixing chamber.

20. The integrated rotary mixer and disperser head according to claim 18, wherein the plurality of elongated slots extends in a direction forming an angle α of between 5 degrees and 55 degrees with the generally axial direction of the mixing chamber, preferably an angle α of between 25 degrees and 55 degrees with the generally axial direction of the mixing chamber, even more preferably an angle α of between 35 degrees and 55 degrees with the generally axial direction of the mixing chamber, yet even more preferably an angle α of between 40 degrees and 50 degrees with the generally axial direction of the mixing chamber, such as an angle α of 45 degrees.

21. The integrated rotary mixer and disperser head according to claim 1, wherein the trailing edge of each of said plurality of slots through the peripheral wall of said mixing chamber forms an acute angle θ with the tangent to the inside of said wall at the point of intersection.

22. The integrated rotary mixer and disperser head according to claim 1, wherein the various parts are made from a metallic material such as stainless steel and rigidly connected to each other by welding so as to form an integral one-piece unit.

* * * * *